United States Patent [19]

Woolner et al.

[11] 4,273,052

[45] Jun. 16, 1981

[54] SPIKE DRIVING APPARATUS

[75] Inventors: John H. Woolner, Pittsburgh; Emeric Gaslevic, Glenshaw; Richard B. Doorley, Pittsburgh, all of Pa.

[73] Assignee: Portec, Inc., Pittsburgh, Pa.

[21] Appl. No.: 889,845

[22] Filed: Mar. 24, 1978

[51] Int. Cl.[3] ..... E01B 29/26

[52] U.S. Cl. ..... 104/17 R; 104/1 R; 227/110

[58] Field of Search ..... 104/17 R, 1 R, 17 A; 173/43, 52, 42; 227/110, 116, 149; 145/29 A, 29 R; 221/233; 403/344, 365; 108/143; 269/73

[56] References Cited

U.S. PATENT DOCUMENTS

| | | | |
|---|---|---|---|
| 1,347,943 | 7/1920 | Forsyth | 104/17 R |
| 1,832,165 | 11/1931 | Wilcox | 221/233 X |
| 1,869,850 | 8/1932 | Hennecke | 145/29 X |
| 1,881,413 | 10/1932 | Mitchell | 173/42 |
| 2,086,694 | 7/1937 | Beegle | 145/29 A |
| 2,272,760 | 2/1942 | Allen | 104/17 R |
| 2,938,412 | 5/1960 | Walker | 145/29 A X |
| 3,257,962 | 6/1966 | Doorley et al. | 104/17 R |
| 3,426,698 | 2/1969 | Foxx et al. | 104/17 R |
| 3,666,155 | 5/1972 | Saluzzi | 227/110 |
| 3,717,101 | 2/1973 | Katcha et al. | 104/17 R |
| 3,753,404 | 8/1973 | Bryan, Jr. | 104/17 R |
| 3,841,222 | 10/1974 | Richeson | 104/17 R |
| 4,006,763 | 2/1977 | Ordonez | 145/29 A X |
| 4,006,993 | 2/1977 | Woerlee | 403/365 X |

FOREIGN PATENT DOCUMENTS 2211606 9/1973 Fed. Rep. of Germany ..... 104/17 A

*Primary Examiner*—Randolph A. Reese

*Attorney, Agent, or Firm*—Webb, Burden, Robinson & Webb

[57] ABSTRACT

Apparatus for driving railroad spikes having at least one pair of hydraulic driving rams and associated spike holders and spike feeding arms. Each ram and its associated spike holder and spike feeding arm is suspended from an adjustable head supported in a mounting frame. Each head is individually movable in a first direction parallel to railroad track rails and in a second direction perpendicular to railroad track rails so that each ram and associated spike holder can be independently adjusted relative to a tie plate hole through which a spike is to be driven and both rams and associated spike holders are adjustable in unison in a first direction parallel to railroad track rails and in a second direction perpendicular to railroad track rails to spot the spikes over the holes in a tie plate through which the spikes are to be driven. A plurality of threaded adjustment members for individually moving each head to set the rams and associated spike holders in a pattern corresponding to the location of the holes in a tie plate and hydraulic cylinders and rods to adjust the rams and associated spike holders in unison to spot the spikes at the holes in each individual tie plate.

20 Claims, 16 Drawing Figures

SPIKE DRIVING APPARATUS

This invention is generally concerned with driving spikes into railroad ties to hold the track rails on the ties. More specifically, the invention is directed to apparatus for inexpensively and rapidly spiking the track rails to ties. Modifications of the invention have applications in driving spikes at a single rail only when a new rail is laid on existing ties or at both rails where individual ties are replaced or new track is laid.

The apparatus of our invention overcomes a number of problems present in the prior art spike driving equipment. In the prior art equipment, jamming of the spike driving mechanism is often caused by bent spikes resulting from poor and inaccurate location of the spike in the spike holder when the spike is supplied to the holder by the feeding mechanism. Bent spikes force the machine operator to stop the machine and remove the bent spike and to manually set a new spike. Jamming also occurs in the prior art machines because the spike holder is not capable of properly positioning spikes with irregular surfaces and because the support arrangement for the driving rams and the associated spike holders must be relatively loose to permit adjustment of the rams and the spike holders. As a result of play in the support arrangement, the control of spikes relative to tie plate holes is difficult. It is also difficult to retain a preset pattern for the spikes in the prior art equipment because of slippage and lost motion caused by the play in the mounting arrangements.

U.S. patents directed to equipment for inserting spikes into railroad track ties which disclose arrangements having one or more of the aforementioned drawbacks are U.S. Pat. Nos. 2,018,129; 3,120,195; 3,257,962; 3,405,649; 3,426,698 and 3,552,320.

An object of our invention is apparatus for driving spikes which has an easily adjustable spike holding and driving mechanism for accurately establishing the spikes in patterns corresponding with the patterns of the holes in tie plates and for quickly spotting the chisel ends of spikes relative to the holes in tie plates after the spike holders are adjusted to the desired pattern. In our machine individual rams and spike holders are easily adjusted in a first direction parallel to the rails and in a second direction perpendicular to the rails, and a pattern is retained once it has been established. The speed and ease of adjustment of the rams and the associated spike holders in our machine results from the use of a novel mounting arrangement which has no play or lost motion and therefore eliminates the problems caused by the loose mounting arrangements in the prior art machines.

In our apparatus each spike is located in a V block holder beneath the head of a driving ram which permits precise movement of the spike and the driving head relative to the hole in a tie plate through which the spike is to be driven. Additionally, the spike holder of our invention is designed to firmly receive and hold a spike with a nonuniform surface.

The apparatus of our invention makes it possible to drive a spike into a tie if the spike is positioned in the spike holder so that it is not parallel with the center line of the driving ram. This advantage substantially eliminates bending a spike during driving. Driving a misaligned spike with the machine of our invention is accomplished by a driving head having a flat contact surface formed with serrations.

Our invention is illustrated in the accompanying drawings in which.

Figure 1:
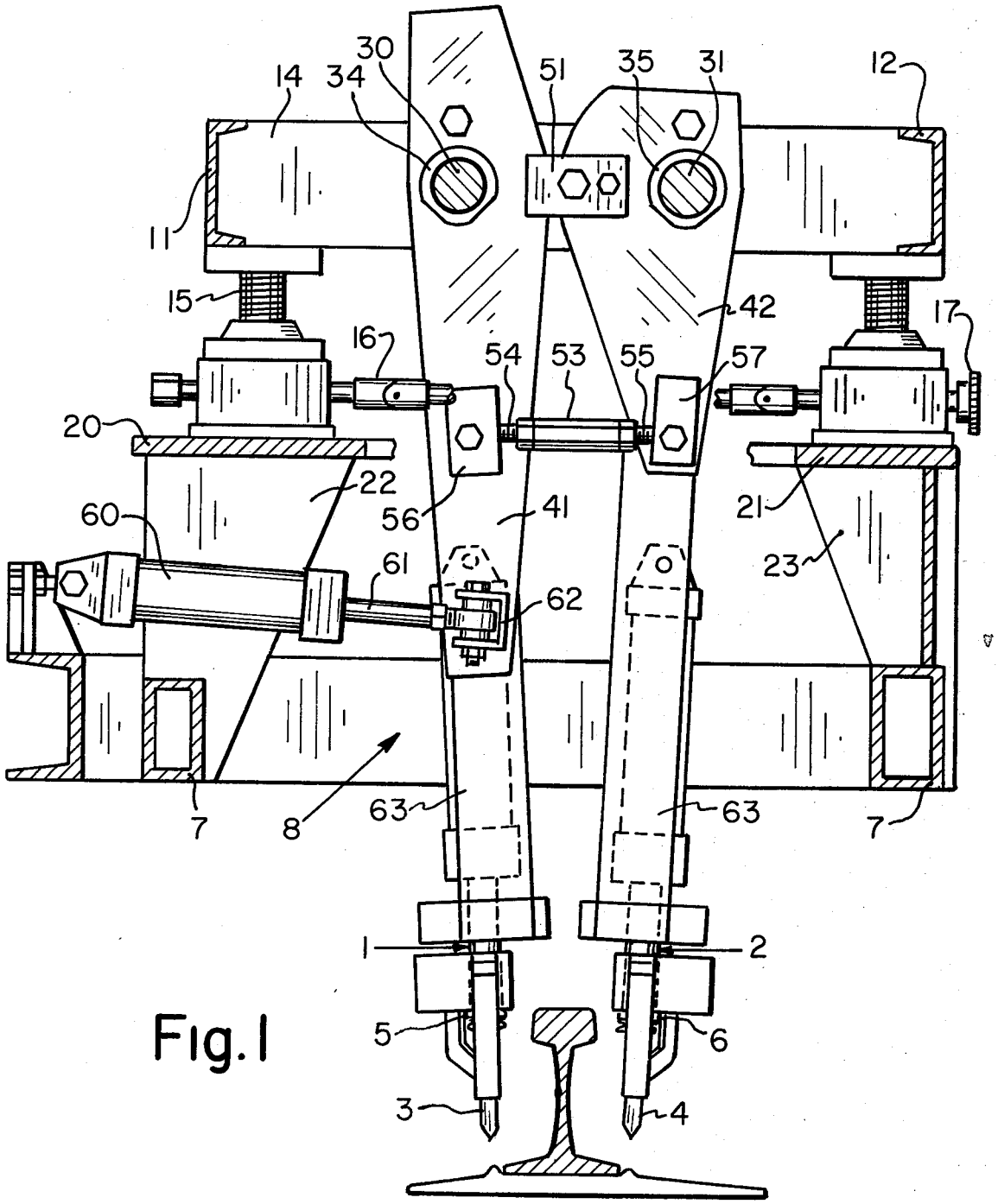
FIG. 1 is an elevation showing apparatus for use in a single rail application.
Figure 2:
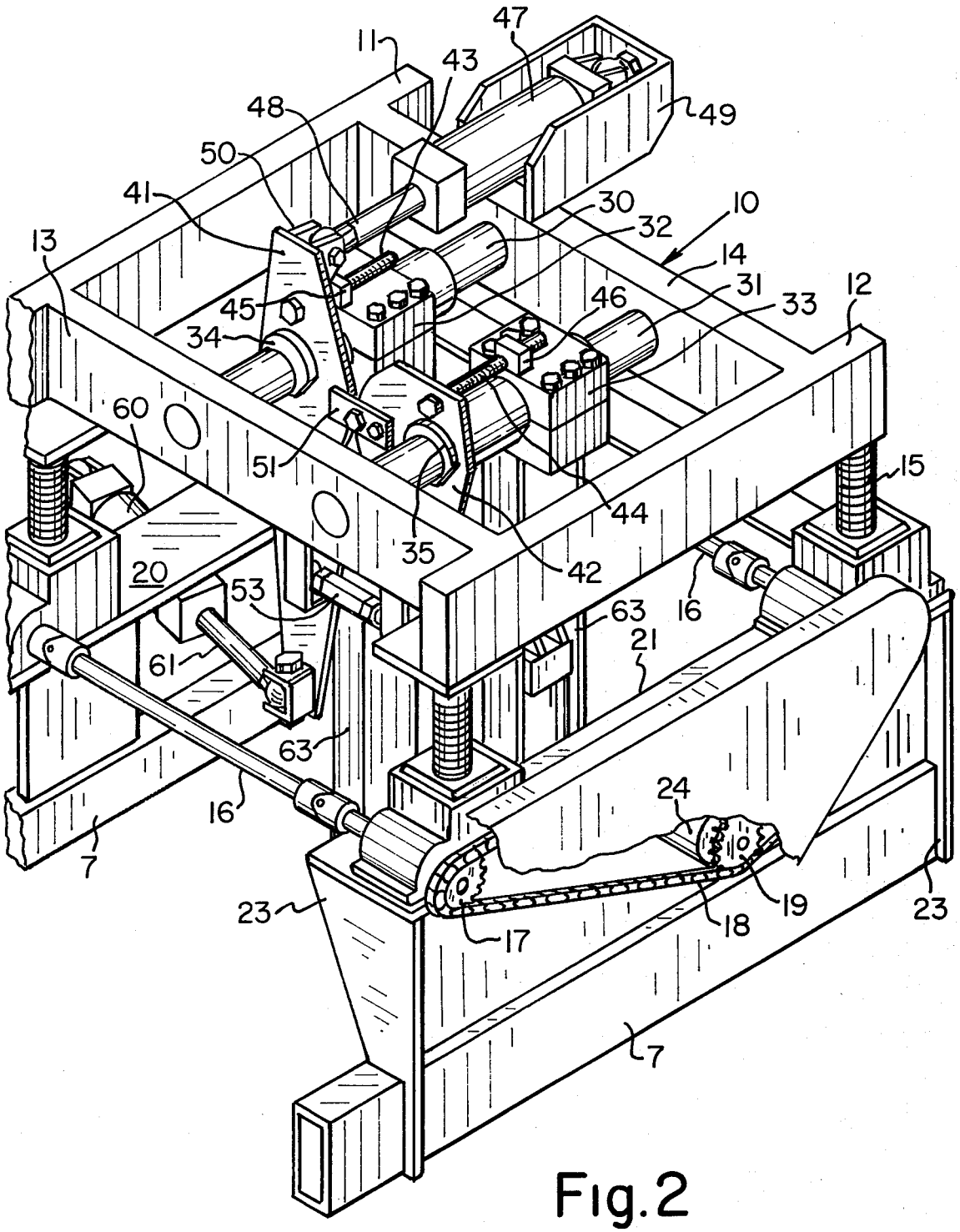
FIG. 2 is a perspective showing of the mounting arrangement for a set of rams and associated spike holders on a single rail machine.

Referring to FIGS. 1 and 2 of the drawings, apparatus is shown for driving spikes into a tie at a single rail which generally occurs when a new rail is being laid on existing ties which are supported in firmly packed ballast. Because the ballast is firmly packed in the single rail application, the spikes are carried from tie to tie with the spike holders in a lowered position which makes it faster and easier to accurately spot the spikes when a tie is reached which is to be spiked. In a double rail application, the spikes must be carried from tie to tie with the spike holder in a raised position since in this application the ballast is loose and is often humped where a new tie has been inserted, and the spikes in the holders must be high enough to clear the ballast during travel. In the single rail apparatus, ram assemblies 1 and 2 drive a pair of spikes 3 and 4 through holes in a tie plate into the underlying tie. The ram assemblies include driving heads 5 and 6 at their lower ends to force the spikes into the tie by hydraulic pressure. A spike is positioned below each driving head in a spike holder which is supported at the lower end of the ram support channel. The rams, the mechanism for feeding spikes to the spike holders and the spike holders are actuated by the machine operator through a circuit to be described hereinafter.

Figure 4:
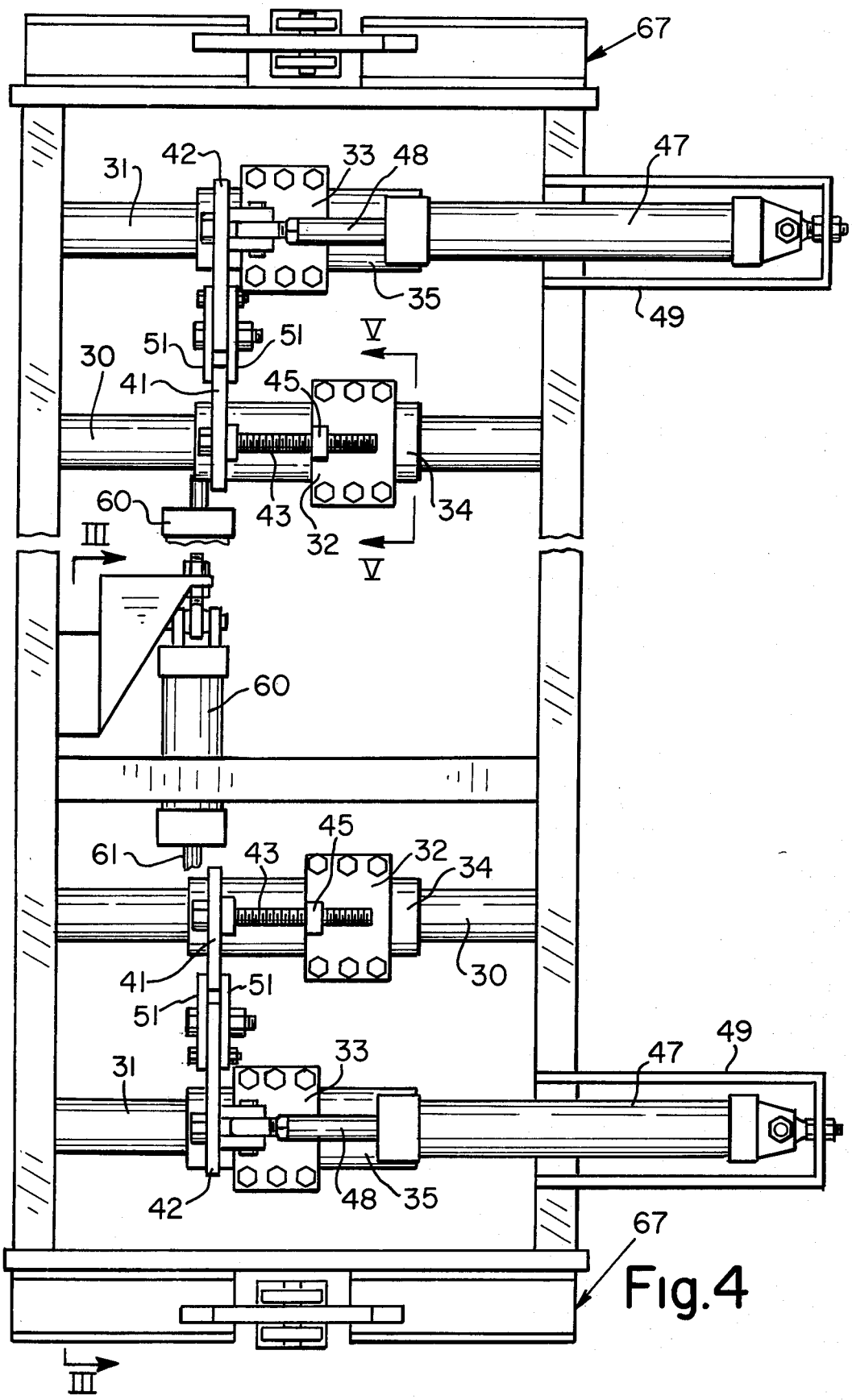
FIG. 4 is a plan view showing a mounting arrangement for two sets of rams for a double rail machine.

In a spike driving machine it is essential that the chisel end of each spike is accurately located relative to the hole in the tie plate through which it is to be driven so that the spike will be driven through the tie plate into the tie. It is also important that the spike pattern remain constant once it is set to correspond with the tie plate hole pattern. In order to accomplish these results our invention includes novel mounting structure for mounting the rams and the spike holders and feed mechanisms which are all carried by the ram support channel. This mounting structure is shown in FIGS. 2 and 4 of the drawings and, as pointed out hereinafter, is basically the same for both the single and the double rail machines. The mounting structure includes a mounting frame 10 having side members 11 and 12 which extend parallel to the rail and end members 13 and 14 which extend perpendicular to the rail and are rigidly connected to members 11 and 12. Mounting frame 10 in the embodiment of FIG. 2 is supported on four identical screw jacks 15 located at the corners of the frame and supported on plates 20 and 21 and angles 22 and 23 on rails 7 of the machine main frame 8. The screw jacks are operably connected by drive rods 16 which are driven by gears 17 which are in turn driven by a chain 18 which passes around a power gear 19 connected to a motor 24. The four jacks are synchronized so that when power is supplied to gear 19 by motor 24 the jacks all move at the same rate. Because of this synchronization, frame 10 is always maintained in parallel relationship with the main frame of the machine and with a plane passing through the track rails.

Figures 5, 6:
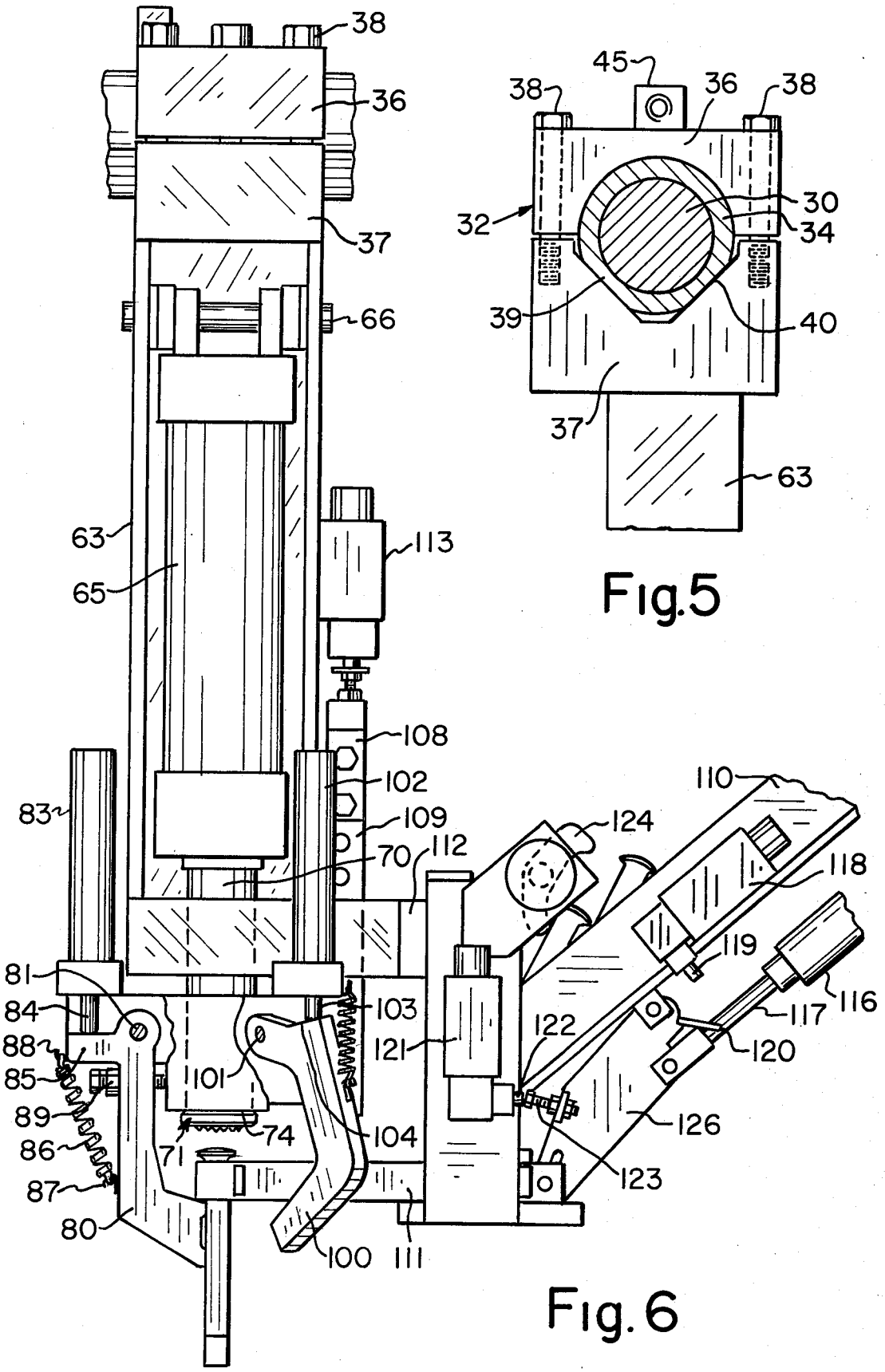
FIG. 5 is a section on line V—V of FIG. 4.
FIG. 6 is an elevation showing the spike holder and driver for both single and double rail machines.

Mounting frame 10 includes an inboard shaft 30 and an outboard shaft 31 which are parallel and which extend between end members 13 and 14. These shafts carry slidable heads 32 and 33 each of which supports a depending ram support channel which carries a hydraulic ram and associated spike holder and feeding mechanism. Each shaft is surrounded throughout a portion of its length by a sleeve designated 34 and 35 each of which supports a slidable head. The sleeves rotate on the shafts for a purpose to be described. Slidable heads 32 and 33 are split into an upper block 36 and a lower block 37. With reference to FIG. 5, it will be seen that the upper and lower blocks are connected by a plurality of bolts 38 which pass through the upper block and are threaded into openings in the lower block. The heads may be moved along on the sleeves in a direction parallel to a track rail to locate the rams and the spikes in the spike holders longitudinally along the rail in the proper position to drive the spikes through tie plate holes into a tie. As shown in FIG. 5 of the drawings, the sleeves have flat surfaces 39 which cooperate with complementary flat surfaces 40 formed by a V-shaped notch in lower block 37 of the heads so that the head and the sleeve do not rotate relative to each other when bolts 38 are tightened to lock the head in position on the shaft.

An adjustment member 41 is fixed adjacent to one end of sleeve 34 on inboard shaft 30, and an adjustment member 42 is fixed adjacent one end of sleeve 35 on outboard shaft 31. These adjustment members are aligned with each other in a direction perpendicular to the track rails. Each adjustment member has a hole formed in the portion extending above the respective sleeve, and the center line of the hole is aligned with the center line of the respective shaft 30 or 31. Threaded adjustment screws 43 and 44 extend through the holes in the upper portions of the adjustment member, and a nut is affixed to the screw adjacent one face of the adjustment member to retain the head end of the screw in the adjustment member. Each screw 43 and 44 has a hexagonal adjustment head adjacent to the face of the adjustment member opposite to the face in contact with the nut. The end of each screw opposite the head end extends through a threaded lug, 45 and 46, attached to the upper block of heads 32 and 33. When an adjustment screw 43 or 44 is rotated and head bolts 38 are loose, the head moves in a direction parallel to the shaft on which it is carried toward or away from the corresponding adjustment member 41 or 42. When each head is properly positioned along its shaft, bolts 38 are tightened. This adjusts the position of the rams and the spikes in associated spike holders in the direction parallel with the track rails.

After the proper relative spacing is set by adjustment of screws 43 and 44, the two heads may be moved in unison to spot the spikes relative to the holes in individual tie plates. Movement of heads 32 and 33 in unison along shafts 30 and 31 is accomplished by a cylinder 47 having a rod 48 mounted in a frame 49 attached to mounting frame 10. Rod 48 extends parallel to and above shaft 30 and is pivotally attached to a lug 50 on the upper extension of adjustment member 41. Adjustment member 42 has fingers 51 bolted to the opposite faces to form an open slot extending toward shaft 30 and embracing member 41. This arrangement makes it possible to slide head 33 along shaft 31 when inboard head 32 is moved along shaft 30 by rod 48 of cylinder 47. Since the heads are not rigidly connected they do not twist or bind on the sleeves during movement along the shafts.

The lateral positions of ram assemblies 1 and 2 relative to each other are determined by a turnbuckle-like adjustment means having a member 53 threadedly connected to left and right hand members 54 and 55 which are respectively pivotally affixed at 56 and 57 on members 41 and 42. When member 53 is rotated, the adjustment members rotate the sleeves which in turn rotate the heads about shafts 30 and 31, and the lower ends of the ram support channels which depend from the heads move toward or away from each other depending upon the direction of rotation.

In order to simultaneously move the rams and associated spike holders in a direction substantially perpendicular to the track rails to spot the chisel ends of the spikes relative to holes in individual tie plates, a cylinder 60 with a rod 61 pivotally attached to a lug 62 at the lower end of adjustment member 41 is used. Cylinder 60 is pivotally mounted on the machine main frame 8 in a conventional manner.

An elongated channel support member 63 depends from each head 32 and 33 to support the rams and associated structure above the track rails. It is shown in FIG. 6 that the upper end of each ram cylinder 65 has upwardly extending lugs attached to a rod 66 extending between the side members of channel 63. This provides a rigid mounting arrangement to maintain the rams and associated spike holders in an established pattern while permitting rapid and accurate spotting at individual ties. In this mounting arrangement, alignment of the various members is inherently built in which is an important advantage of our design as it eliminates binding when the position of the rams is changed and eliminates slippage and play between the two rams after a pattern has been set.

In the operation of our machine the rams and associated spike holders are first adjusted to the desired tie plate hole pattern in the following manner. Bolts 38 on heads 32 and 33 are loosened, and the inboard head is adjusted along shaft 30 on sleeve 34 by screw 43. When the inboard head is in the proper longitudinal position along the rail relative to an inboard hole in the tie plate, bolts 38 in head 32 are tightened to bring upper and lower blocks 36 and 37 together and to lock the head on sleeve 34. Outboard head 33 is adjusted along shaft 31 on sleeve 35 in the same manner as the inboard head. With the heads properly positioned along shafts 30 and 31 on sleeves 34 and 35, adjustment means 53 is rotated to move adjustment members 41 and 42 relative to each other and thereby space the chisel ends of spikes relative to openings in the tie plate on opposite sides of the rail.

Once the desired tie plate hole pattern is determined and the rams and associated spike holders are positioned in the pattern, the motor for gear 19 is operated to simultaneously lower the four synchronized screws 15 and move mounting frame 10 downwardly to position the chisel ends of the spikes close to the tie plate for rapid spotting and driving of spikes. When necessary, cylinders 47 and 60 are actuated to spot spikes to compensate for an operator error in stopping the machine or for variation in rail gauge.

Figure 3:
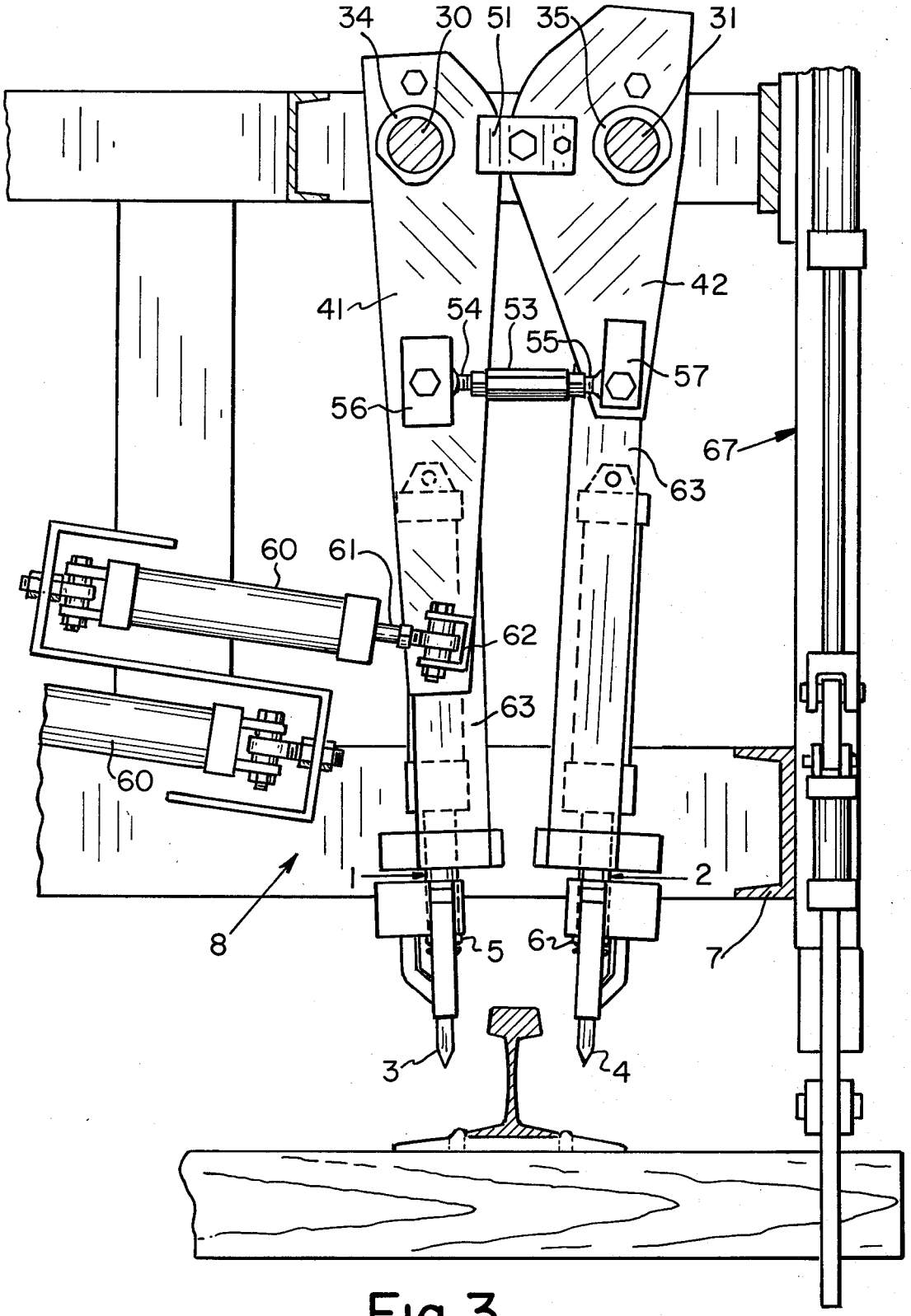
FIG. 3 is a section on line III—III of FIG. 4.

In FIGS. 3 and 4 of the drawings we have shown a machine carrying four rams with associated spike holders. Two rams are located at each rail so that the machine is capable of simultaneously driving spikes into a tie at both rails. The machine shown in FIGS. 3 and 4 is a double rail machine in contrast to the machine shown in FIGS. 1 and 2 which spikes at only one rail of the track. However, the mounting structure for the rams and associated spike holders on the double rail machine is the same as that shown in FIGS. 1 and 2 for the single rail machine except that in the arrangement of FIGS. 3 and 4, the mounting frame is fixed to the machine main frame. The mounting frame is fixed to the machine main frame in the double rail machine because this machine is used under conditions where the ballast is loose and often humped higher than the upper surface of a tie plate as when replacing a tie, and, therefore, the machine cannot travel with the spikes in a lowered position.

In the apparatus shown in FIGS. 3 and 4 the portions on opposite sides of the center line are identical and like reference numerals are used with reference to like parts. Additionally, the portions on opposite sides of the center line operate in the same way so that the operation of only one portion is described hereinafter. Each portion of the apparatus in FIGS. 3 and 4 is also the same as the apparatus shown in FIGS. 1 and 2 with the exception of the location of cylinders 47. The numerals in FIGS. 3 and 4 are the same as in FIGS. 1 and 2.

In the apparatus of FIGS. 3 and 4, heads 32 and 33 at each rail are moved in a direction parallel to the rail by screws 43 and 44 which extend through the upper ends of adjustment members 41 and 42 into lugs 45 and 46 on the upper blocks 36 of the heads. As shown in FIG. 4, cylinder 47 is attached to the outboard adjustment member 42 by rod 48 rather than to the inboard adjustment member as in the embodiment of FIGS. 1 and 2. The adjustment and the operation of each set of rams and associated spike holders in FIGS. 3 and 4 are the same as in FIGS. 1 and 2, and reference is made to the description of the adjustment and the operation described herein for the apparatus shown in FIGS. 1 and 2. Thus, in each set of rams, each ram and associated spike holder is independently adjusted to the desired pattern corresponding to the tie plate hole pattern and each set is independently spotted at a tie plate where spotting is necessary.

The embodiment of FIGS. 3 and 4 of the drawings includes a tie nipper assembly 67 at each end of the machine. The tie nipper assemblies are mounted on the machine main frame 8 outboard of each rail and are conventional in design. The nippers grasp the ends of a tie and hold the rails firmly against the wheels of the machine when spikes are forced into the tie by the rams. When the rams exert a downward thrust on the spikes to force the spikes into the tie, no relative movement takes place between the machine and the rail. Thus, the tie and the rails are firmly held relative to the machine and to the driving rams when the spikes are forced into the tie.

Figure 14:
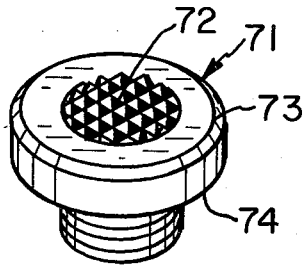
FIG. 14 is a perspective of the ram drive head.

Our invention includes a novel arrangement for feeding and holding a spike beneath a ram prior to driving the spike into a tie. This arrangement is shown in FIGS. 6–10 of the drawings. With specific reference to FIG. 6, it will be seen that a driving ram 70 is located within cylinder 65 which is supported by channel member 63 depending from a head. The ram 70 has a driving head 71 at its lower end. The head is shown in detail in FIG. 14 of the drawings.

The head is T-shaped in vertical section and has a flat cylindrical face with a serrated contact portion 72. The upper and lower circumferential edges 73 and 74 of head 71 are angular. The serrated contact portion of the head makes it possible to drive a spike even though the center line of the ram is not parallel with the center line of the spike, as the serrations provide frictional contact with the rounded spike head of a spike even if the spike is at an angle relative to the center line of the ram. Such misalignment may occur when a spike is not properly aligned in jaw 80 of the spike holder. This is a distinct advantage over the prior art spike drivers having a concave driving head with a smooth surface which slides off a rounded spike head when the center line of the hammer or ram is not aligned with the center line of the spike. When this happens the spike bends, and it is necessary to stop the machine and manually remove the bent spike and set a new spike in position. Our arrangement eliminates bending spikes even when the spike enters a hole in a tie plate at an angle relative to the center line of the ram.

A cross member 82 is located at the lower end of the ram and is movable vertically therewith. A jaw member 80 is pivoted to cross member 82 at 81. An air cylinder 83 is mounted on cross member 82 and has a downwardly extending rod 84 in contact with a shoulder 85 on jaw 80. A spring 86 is attached at one end to a hook 87 on jaw 80 and at the other end to a hook 88 on cross member 82. An adjustment screw 89 with a lock nut controls the extent of the angular motion of jaw 80 about pivot 81 to position the spike in notch 90 in alignment with the center line of driving ram 70. Spring 86 pivots jaw 80 outwardly about pivot point 81 when pneumatic cylinder 83 is deenergized to permit retraction of rod 84. This arrangement will permit our apparatus to drive a preset spike, i.e. a spike which is manually placed in a tie plate hole.

Figure 9:
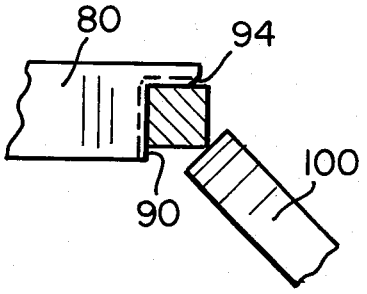
FIG. 9 is a section on line IX—IX of FIG. 7.
Figure 10:
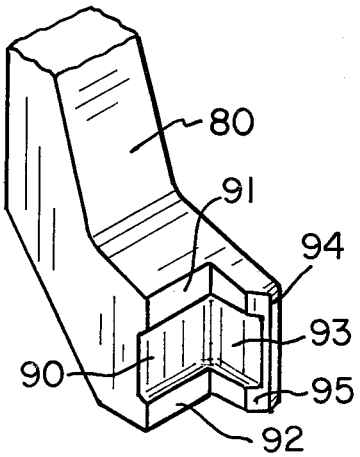
FIG. 10 is a perspective showing a spike jaw.

Jaw 80 is formed at the end of its lower extension with a notch 90 as shown in FIGS. 9 and 10. The notch has upper and lower parallel contact edges 91 and 92 which define a cutout or recessed portion 93. The cutout portion 93 of notch 90 limits the contact between the jaw and the spike to contact edges 91 and 92 so that a spike with irregularities, rust or other foreign matter on its surface will be firmly received within the notch. A vertical edge 94 of notch 90 is formed with an angle 95 to accommodate the entry of a spike into the notch.

A second jaw 100 of the spike holder is pivoted to cross member 82 at 101 and is positioned at approximately at 45° angle with respect to jaw 80 as shown in FIG. 9 of the drawings. Jaw 100 is pivoted into the closed position shown in FIG. 7 by an air cylinder 102 having a rod 103 extending downwardly therefrom to contact shoulder 104 on jaw 100. In the closed position, jaw 100 holds a spike in notch 90 of jaw 80 until the chisel end of the spike is forced into a tie by ram drive head 71. A spring 105 is attached to a hook 106 on jaw 100 at one end and to a hook 107 on cross member 82 at the other end. The spring pivots jaw 100 about pivot 101 when pressure is removed from cylinder 102 to permit retraction of rod 103. This occurs prior to a spike being moved by arm 111 into notch 90 as shown in FIG. 6 of the drawings. The chute and the arm and the operating mechanisms therefor are supported from a member 112 which is attached to the lower ends of elongated support member 63.

When a spike is supplied to notch 90, cylinder 102 is actuated to extend rod 103 to pivot jaw 100 toward the spike. Extension of rod 103 is initiated by a limit switch 113 with a depending plunger 114 which is mounted on member 63. A member 108 is adjustably attached by bolts to a vertical member 109 extending upwardly from cross member 82, and members 108 and 109 move vertically as the cross member is raised and lowered with the ram. A disc 115 is carried at the upper end of member 108 to contact plunger 114 so that switch 113 opens when cross member 82 begins to descend and closes when the cross member is in the raised position. Switch 118 is interlocked in a circuit with the control for cylinder 116 which actuates arm 111 so that 111 cannot extend beneath the ram 70 unless the ram is in its fully up position. When switch 113 is closed, cylinder 116 is pressurized, and rod 117 is extended to rotate crank arm 126 about its pivot and cause arm 111 to carry a spike to notch 90 in jaw 80 as shown in FIG. 6 of the drawings.

Figure 7:
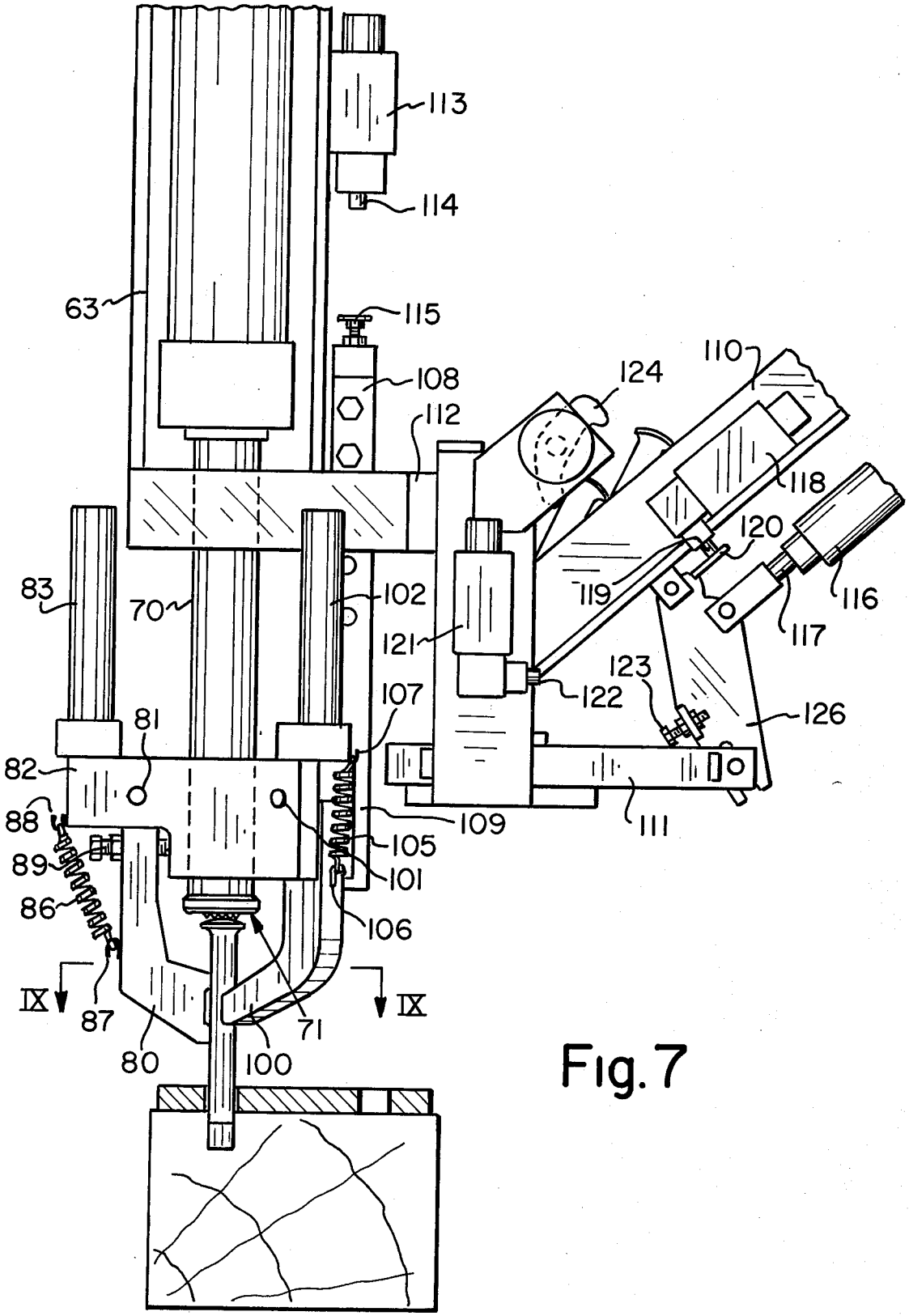
FIG. 7 is an elevation similar to FIG. 8 showing a spike started into a tie.
Figure 8:
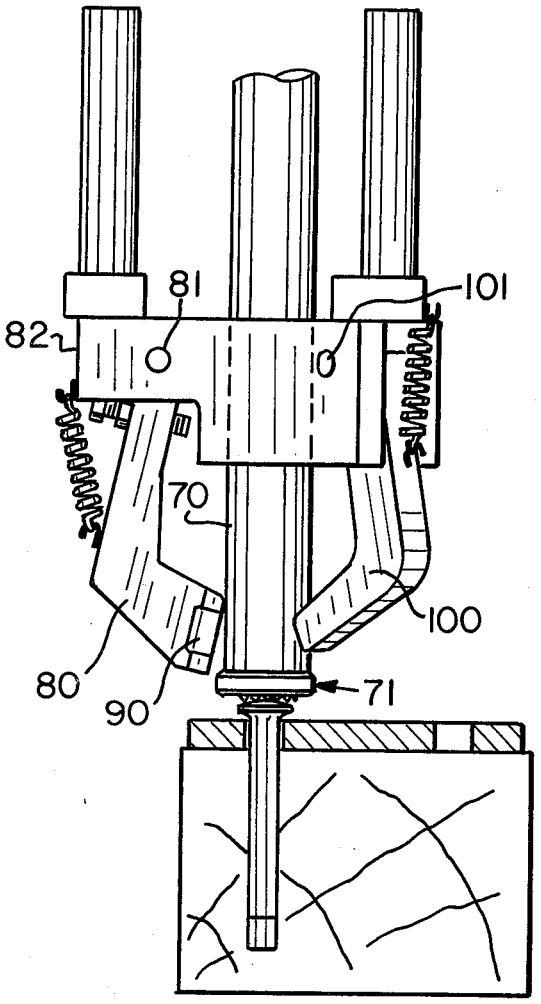
FIG. 8 is an elevation showing a spike completely driven into a tie.

Member 108 is attached to vertical member 109 by bolts which fit into openings in member 109 so that member 108 is vertically adjustable on member 109. The shoulder formed by the bottom of member 108 contacts support member 112 to terminate the downward travel of member 109, cross member 82 and jaws 80 and 100. The bottom position of the jaws is shown in FIG. 7 wherein the shoulder formed by the bottom of member 108 is in contact with the upper edge of member 112. When downward movement of the jaws terminates, ram 70 continues to drive the spike, and the driving head 71 spreads jaws 80 and 100 in the manner shown in FIG. 8. The upper and lower circumferential edges 73 and 74 of the driving head are angled so that the head can easily spread the jaws during both upward and downward travel.

In the operation of the spike feeding mechanism, contact between the end of screw 123 and plunger 122 of limit switch 121 actuates switch 121 to pressurize cylinder 102 and extend rod 103 to contact shoulder 104 on jaw 100 and close the jaw on a spike which is then held in notch 90 of jaw 80 by arm 111 as shown in FIG. 6. At the same time that the switch 121 actuates cylinder 102, it also actuates cylinder 116 to retract rod 117 and pivot crank arm 126 about its pivot to retract arm 111 from beneath the ram. When arm 111 is retracted, the spike is held in notch 90 of jaw 80 by jaw 100.

As stated above, switch 118 is an interlock to prevent downward movement of ram 70 when arm 111 is not fully retracted from beneath the ram. Cam member 124 is actuated by the machine operator to release a spike from chute 110 when ram 70 and cross member 82 are in the lower position shown in FIG. 7 of the drawings. As the spike slides through the lower portion of chute 110, it enters a receiving notch in arm 111, and it contacts the edge of vertical member 109 which blocks the opening of the notch in arm 111 and thereby prevents the spike from bouncing out of the notch in the arm.

Figure 11:
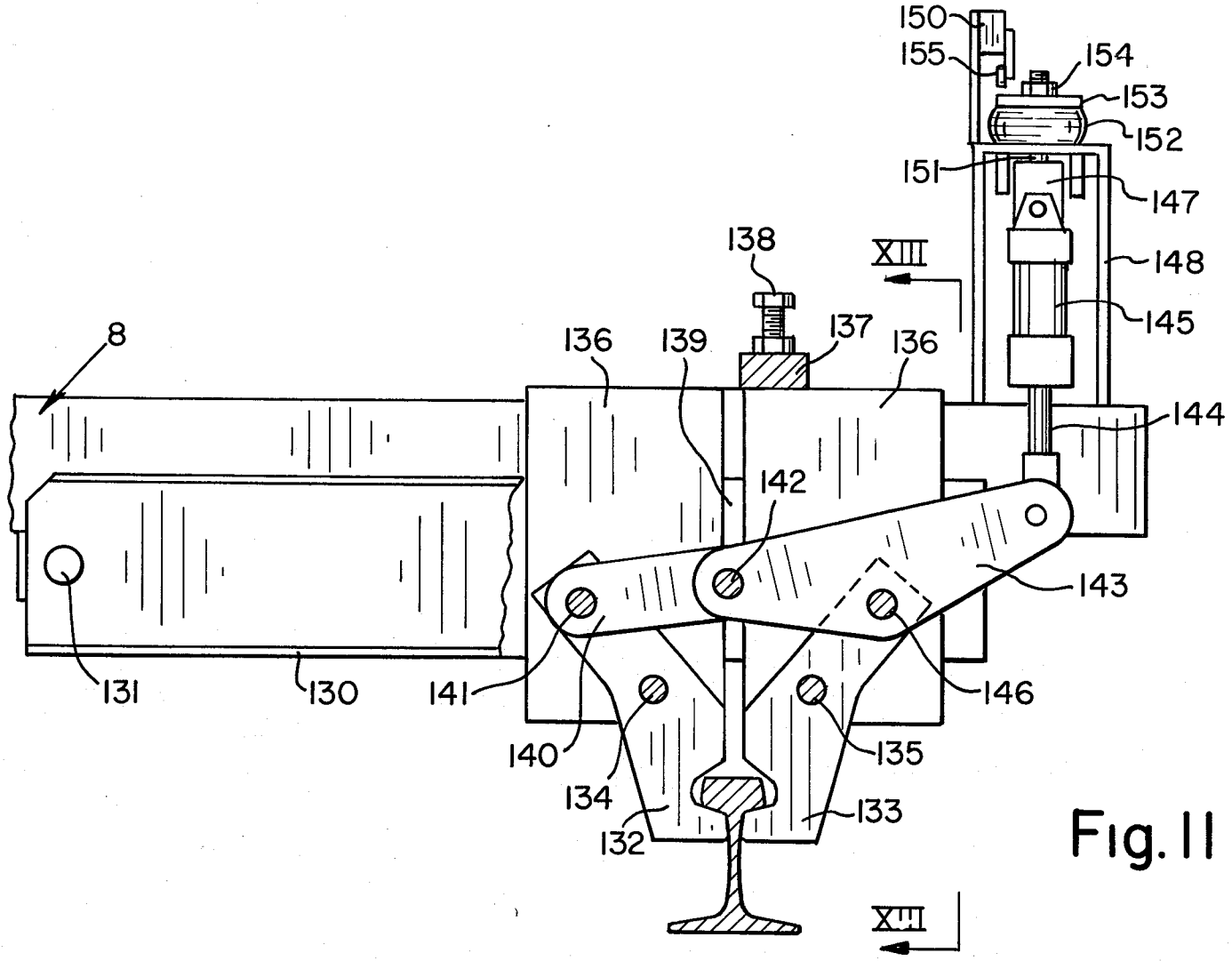
FIG. 11 is an elevation showing the rail clamp in closed position.
Figure 12:
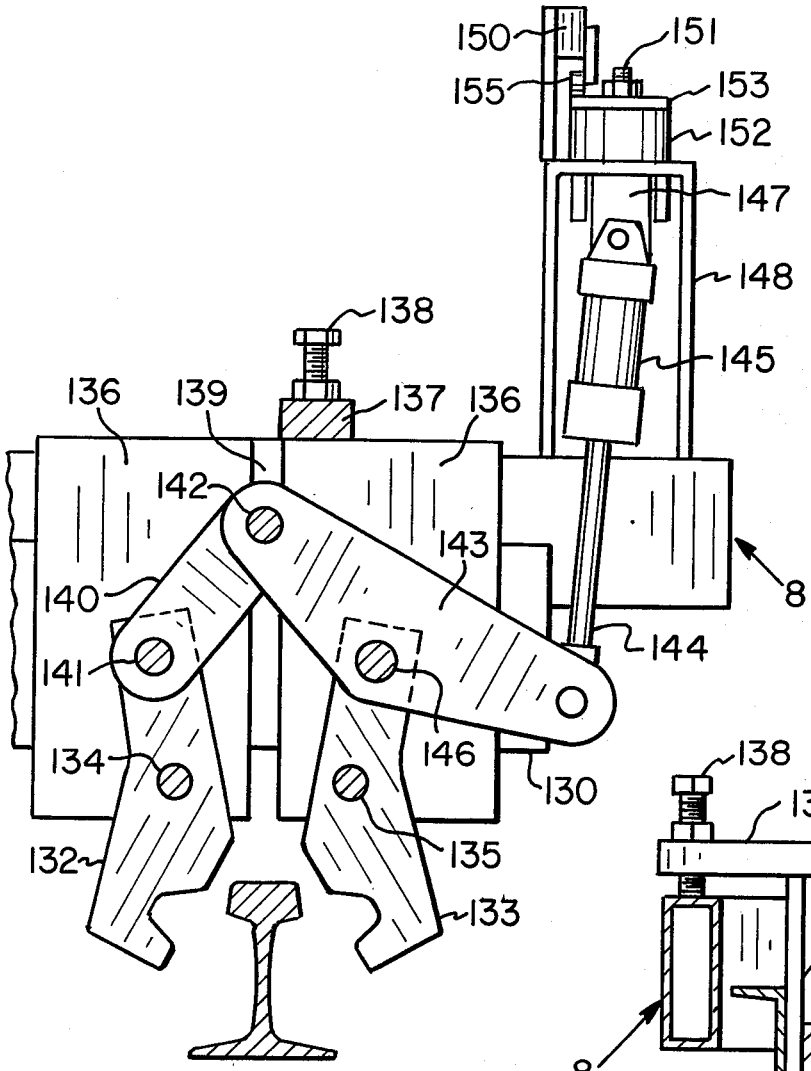
FIG. 12 is an elevation showing the rail clamp in open position.
Figure 13:
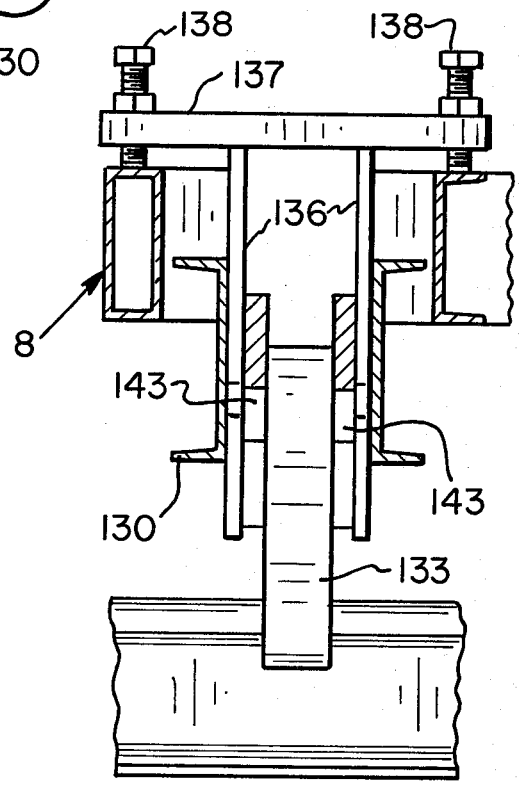
FIG. 13 is a section on line XIII—XIII of FIG. 11.

In FIGS. 11–13 of the drawings we have shown a rail dog arrangement for grasping the bottom of the head of a rail when the single rail apparatus shown in FIGS. 1 and 2 is utilized. A mechanism as shown in FIGS. 11–13 is located at each end of the machine to hold the machine on the rail during driving. The arrangement includes elongated members 130 pivotally mounted at 131 to the machine main frame 8. The rail dog has two clamp members 132 and 133 supported on pivot pins 134 and 135 which are mounted on spaced members 136 attached to members 130. The spaced members depend from an upper member 137, and a slot 139 is formed therein. Stop screws 138 in member 137 determine the lowermost position of members 130, and consequently the position of the fingers on clamps 132 and 133 below the rail head. A link 140 is pivotally attached at 141 to the upper end of clamp member 132. The opposite end of link 140 is attached to a pin 142 which extends through slot 139 in members 136. A drive link 143 is attached at one end to pin 142 and at its other end to the lower end of a rod 144 of cylinder 145. Intermediate its ends, drive link 143 is attached to clamp member 133 by a pivot pin 146.

Cylinder 145 is supported from a lug 147 on a support frame 148 carried on the machine main frame. A limit switch 150, located at the upper end of frame 148, prevents driving with the clamp members disengaged from the head of the rail. A shaft 151 extends upwardly through the top of frame 148 and is threaded at its upper end. A rubber torus 152 surrounds the shaft, and a plate 153 lies on top of the torus and is held in place by a nut 154. Limit switch 150 has a contact 155 at its bottom, and when the rubber torus is in its static condition, the top of plate 153 is against contact 155 to push the contact upwardly and thereby open switch 150 to interrupt a control circuit and stop the downward motion of the rams. As shown in FIG. 11 of the drawings, when the clamps are closed and the fingers are snug against the underside of the rail head, the rubber torus is squeezed by plate 153 because the cylinder is exerting an upward force on the end of drive link 143 which tends to pull plate 153 downwardly which closes the contact in switch 150. Alternatively, as shown in FIG. 12, when the clamp members are open and cylinder rod 144 is extended, upper end of cylinder 145 moves upwardly which permits rubber torus 152 to move into a static position to raise plate 153 and force contact 155 upwardly to open the switch. Thus, the switch is opened when the rail dogs are not in contact with a rail head. Because of the design of the clamp actuating mechanism, our system has an automatic interrupt if the clamps slip off the rail head during driving.

In the operation of the rail dog arrangement, rod 144 is extended by cylinder 145 to pivot drive link 143 about pivot 146 which rotates the clamp members about pins 134 and 135 into the open position shown in FIG. 12. Alternatively, when rod 144 is retracted by cylinder 145, it rotates drive link 143 about pivot 146 which moves pin 142 downwardly in slot 139 and forces link 140 outwardly at pivot 134 to close the clamp members beneath the rail head. When a spike is held in notch 90 by jaw 100, the rail dogs are in the position shown in FIG. 11 of the drawings clamping the rail head so that when the spike and the ram are moved downwardly into the position shown in FIG. 7 of the drawings, the machine will not rise off the rail head. The fingers on clamp members 132 and 133 extend beneath the head of the rail during spike driving which prevents the clamp members from slipping off the rail. In prior art machines clamps contact the sides of the rail head and can slip off which derails the machine. The prior art machines required a mechanism for rerailing the machine which is not necessary in our machine because the rail clamps prevent derailing.

Figure 15:
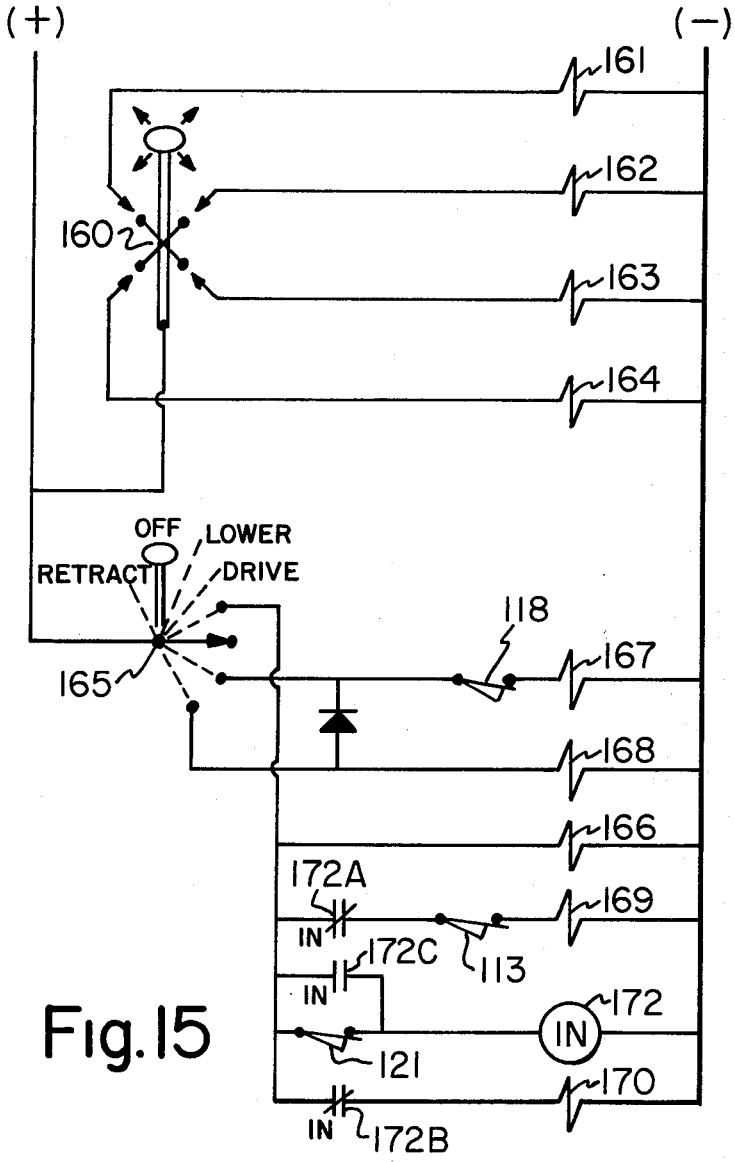
FIG. 15 is a control circuit for use with our invention.

FIG. 15 of the drawings shows a control circuit for one driving ram and the associated spike holder and spike feeding mechanism of our machine. The circuit of FIG. 15 is duplicated for each driving ram on the machine. The operation of the apparatus according to the circuit shown in FIG. 15 is set forth hereinafter.

When a spike is in the spike holder below driving head 71, driving is initiated by a four-position manual switch 165 which is moved to the "Lower" position on the control panel. With limit switch 118 closed, hydraulic solenoid valve 167 is actuated to lower jaws 80 and 100 which are holding the spike until the chisel end of the spike is immediately above the tie plate at which time switch 165 is moved to the off position to stop the downward movement. With the spike in its lower position manual switch 160 may be moved by the machine operator to spot the spike over a hole in the tie plate.

If it is necessary to spot the spike, switch 160 is moved to actuate hydraulic solenoid valves 161, 162, 163 and 164 to move the heads 32 and 33. Solenoid valves 162 and 164 operate cylinder 47 to move the heads parallel to the track rail. Solenoid valves 161 and 163 operate cylinder 60 to move the heads perpendicular to the track rail. The solenoid valves are well known in the art and are not part of our invention.

After spotting the spikes, the machine operator moves switch 165 to the "Drive" position which energizes pneumatic valve 168 to actuate cam member 124 and permit a spike to drop into a notch in arm 111. Valve 167 is simultaneously energized to actuate cylinder 65 and ram 70 to complete the driving operation.

When driving is completed the operator moves switch 165 to the "Retract" position which energizes valve 166 to actuate cylinder 65 and raise ram 70 and the associated spike holder. Upon reaching the fully retracted position, limit switch 113 is closed to complete the circuit to pneumatic valve 169 to actuate air cylinder 116 to extend rod 117 and thereby move arm 111 with a spike held therein toward jaw 80. When the spike is in notch 90 in jaw 80, jaw 100 is pivoted into clamping position by closing limit switch 121 which energizes relay 172 to open a normally closed contact 172A to deenergize pneumatic valve 169 and retract arm 111. Simultaneously contact 172B opens to deenergize clamp jaw valve 170 so that jaw 100 pivots to contact the spike and hold it firmly in notch 90 in jaw 80. The retraction of arm 111 is slightly delayed so that the jaw 100 can firmly close on the spike before the arm starts to retract. With jaw 100 closed, contact 172C closes to maintain relay 172 in the energized state. When the operator moves switch 165 to "off," relay 172 deenergizes to return all contacts to their normal positions and complete the driving cycle. As stated above, limit switch 118 is a safety interlock to prevent actuation of the ram when arm 111 is not fully retracted. Otherwise the ram could damage arm 111 or the associated spike holding and feeding mechanism.

Figure 16:
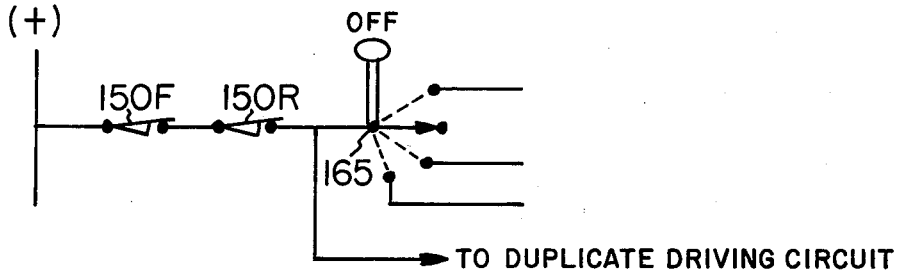
FIG. 16 is a modification of the circuit shown in FIG. 15.

FIG. 16 is a modification of the circuit shown in FIG. 15 for a machine which includes the rail clamps shown in FIGS. 11–13. The modified circuit includes a safety switch 150F for the rail clamps at the forward end of the machine and a safety switch 150R for the rail clamps at the rear end of the machine. The switches are normally closed, and if the clamps at either end of the machine are not engaged with the rail head, the switch for these clamps opens by the contact between plate 153 and contact 155 on the switch. Thus, the clamps slip off the rail during driving, the driving circuit is immediately interrupted and the machine will not derail.

While we have described preferred embodiments of our invention herein, it is to be understood that it may be embodied within the scope of the following claims.

We claim:

1. Spike driving apparatus including a frame adapted to be mounted on a vehicle, at least two adjustment means supported on said frame, an elongated support member depending from each of said adjustment means, means for independently moving each of said adjustment means and the corresponding depending elongated support member in a first direction, means for rotating said depending elongated support members about the upper ends to move the lower ends relative to each other in a second direction substantially perpendicular to the first direction, means operatively connecting said adjustment means for unisonant movement of said adjustment means and said depending elongated support members in said first direction, means for unisonously moving the lower ends of said depending elongated support members in said first direction and angularly in said second direction, each of said depending elongated support members supporting a ram and hydraulic cylinder and spike holding means, said spike holding means located at the lower end of said depending elongated support member and adapted to hold a spike in a position to be driven by downward movement of said ram, and means to lower said ram to drive a spike.

2. Apparatus as set forth in claim 1 wherein said adjustment means on said frame includes a pair of parallel elongated shafts, each of said shafts having a sleeve around a portion thereof, a head surrounding a portion of each of said sleeves and slidable along each of said sleeves, the portion of each of said heads surrounding said sleeves being formed with flat surfaces and said sleeves being formed with flat surfaces to cooperate with the flat surfaces in said heads, means for locking each of said heads to a sleeve, whereby said heads cannot rotate on said sleeves due to said flat surfaces.

3. Apparatus as set forth in claim 2 wherein each of said heads has an upper block and a lower block and said means for locking said heads to said sleeves is a plurality of threaded members extending through said upper block into threaded holes in said lower block.

4. Apparatus as set forth in claim 2 including a first adjustment member fixed to one of said sleeves and a second adjustment member fixed to the other of said sleeves, said first adjustment member having an upward extension and a lower extension and said lower extension being attached to said means for unisonously moving the lower ends of said depending elongated support members angularly in said second direction, said second adjustment member being attached to said first adjustment member by said means for rotating said depending elongated members, said second adjustment member having means extending toward said first adjustment member and forming a slot embracing said first adjustment member whereby movement of said first adjustment member in said first direction will move said second adjustment member in said first direction.

5. Apparatus as set forth in claim 1 including a plurality of threaded jacks adapted to support said frame on a vehicle, a common power source driving said jacks to raise and lower said jacks at the same rate to move said frame and said depending elongated support members.

6. Apparatus as set forth in claim 1 wherein said means for unisonously moving said depending elongated support members in said first and second directions are hydraulic cylinders.

7. Apparatus as set forth in claim 1 wherein each of said rams has a driving head at its lower end, each of said driving heads having a flat contact surface and a portion of said contact surface being formed with serrations adapted to contact the head of a spike being driven.

8. Apparatus as set forth in claim 7 wherein each of said driving heads is formed at the upper and lower circumferential edges with angular surfaces.

9. Apparatus as set forth in claim 1 wherein said spike holding means includes a first jaw adapted to depend below said ram and a second jaw positioned at an angle of about 45° to the center line of said first jaw and adapted to move toward said first jaw, said first jaw having a notch formed therein adapted to receive a spike, the surface of said notch being formed with upper and lower contact edges and a recessed center portion.

10. Apparatus as set forth in claim 9 wherein said notch is formed with a vertical edge and said vertical edge is angled to facilitate the receipt of a spike into said notch.

11. Apparatus as set forth in claim 1 wherein said spike holding means has a first jaw and a second jaw, said first and second jaws are pivotally attached to a cross member surrounding said ram and raised and lowered with said ram through a portion of the vertical travel of the ram during driving, an air cylinder having a rod operatively engaging each of said jaws to urge said jaws toward each other, a spring attached to each of said jaws at one end and to said cross member at the opposite end to urge said jaws away from each other, whereby pressure in said air cylinders extends said cylinder rods to overcome the tension of said springs to urge said jaws toward each other to hold a spike.

12. Apparatus according to claim 11 including a spike chute and an arm at the lower end of each of said support members, means for feeding a spike from said spike chute into said arm, and means to move said arm toward said first jaw to carry a spike from said chute to said first jaw.

13. Apparatus as set forth in claim 1 wherein said frame includes additional adjustment means adapted to support the upper ends of two depending elongated support members.

14. Apparatus as set forth in claim 1 wherein said frame is adjustably mounted on a railroad track spiking machine, said spiking machine including means at each end to clamp the machine to a track rail when said means to lower said ram is actuated to drive a spike, whereby said machine will not derail when a spike is being driven.

15. A mounting frame having rigidly connected side members and end members, at least two parallel elongated shafts extending between said end members, each of said shafts having a slidable sleeve around a portion of its length, a head surrounding a portion of each of said sleeves and slidable along each of said sleeves, the portion of each of said heads surrounding said sleeves being formed with flat surfaces and each of said sleeves being formed with flat surfaces to cooperate with corresponding flat surfaces in said heads, means for locking each of said heads to a sleeve, whereby said heads cannot rotate on said sleeves due to said flat surfaces and means connecting said sleeves for unisonant movement of said sleeves along said shafts.

16. Apparatus adapted to hold a spike in a substantially vertical position, said apparatus including a support member, a first jaw pivotally connected to depend directly from said support member and a second jaw pivotally connected to depend directly from said support member and located in a vertical plane at an angle of about 45° with the vertical plane including said first jaw, means to rotate said first and second jaws relative to said support member and relative to each other, said first jaw having a notch formed therein adapted to receive a spike and said second jaw adapted to contact a spike located in said notch to hold the spike firmly in said notch.

17. Apparatus as set forth in claim 16 wherein said notch in said first jaw is defined by a pair of faces located at substantially 90° to each other, each of said faces having spaced upper and lower contact edges and a recess portion between said contact edges, whereby a spike located in said notch contacts said contact edges.

18. Apparatus as set forth in claim 17 wherein said notch has vertical edges on said faces extending between said upper and lower contact edges, one of said vertical edges being formed with an angle to facilitate entry of a spike into said notch.

19. Apparatus as set forth in claim 16 including a cylinder on said support member above each of said jaws, each of said cylinders having a depending rod, each of said jaws having a shoulder at its upper end operatively engaged with the rod of a cylinder to pivot said jaw about its pivotal connection with said support member and thereby move the lower ends of said jaws toward each other, a spring extending between each jaw and said support member, each spring being attached to a jaw adjacent to the lower ends of the jaw and being attached to said support member, whereby said springs pivot said jaws about the pivotal connection with said support member and thereby move the lower ends of said jaws away from each other.

20. Apparatus according to claim 16 including a spike chute and a spike carrying arm located adjacent to said jaws, means to feed a spike from said spike chute into said carrying arm, and means to move said carrying arm toward said first jaw to carry a spike to said notch in said first jaw, whereby a spike is supplied to said notch in said first jaw by said carrying arm.

* * * * *